US011312542B1

(12) United States Patent
Hsu

(10) Patent No.: US 11,312,542 B1
(45) Date of Patent: Apr. 26, 2022

(54) CLOSURE DEVICE FOR FLEXIBLE BAG

(71) Applicant: Wei K. Hsu, Plano, TX (US)

(72) Inventor: Wei K. Hsu, Plano, TX (US)

( * ) Notice: Subject to any disclaimer, the term of this patent is extended or adjusted under 35 U.S.C. 154(b) by 0 days.

(21) Appl. No.: 17/524,207

(22) Filed: Nov. 11, 2021

(51) Int. Cl.
*B65D 33/16* (2006.01)

(52) U.S. Cl.
CPC ..... *B65D 33/1675* (2013.01)

(58) Field of Classification Search
CPC ..... Y10T 24/15; B65D 33/1675
See application file for complete search history.

(56) References Cited

U.S. PATENT DOCUMENTS 863,993 A * 8/1907 Hunter ..... A47H 13/00 160/330
899,612 A * 9/1908 Phillips ..... B65D 33/1675 24/30.5 R
1,183,819 A 5/1916 Keiser
1,898,650 A 2/1933 Whiteaker
2,601,568 A 6/1952 Sussenbach et al.
3,141,221 A 7/1964 Faulls
3,266,711 A 8/1966 Song
3,414,140 A 12/1968 Feldkamp
3,481,007 A 12/1969 Scarritt, Jr.
3,797,792 A * 3/1974 Huber ..... A61M 5/1415 248/229.26
4,903,629 A 2/1990 Maudlin et al.
5,050,272 A * 9/1991 Robinson ..... B65D 33/1675 24/30.5 R
5,125,133 A * 6/1992 Morrison ..... A61F 5/4407 24/30.5 P
5,379,489 A * 1/1995 Delk ..... B65D 33/1675 24/30.5 R
5,613,282 A 3/1997 Deddens et al.
5,752,297 A 5/1998 Ramey
5,772,034 A 6/1998 Lin
6,678,922 B2 1/2004 Comer et al.
6,702,794 B2 * 3/2004 Blum ..... A61F 5/4407 24/30.5 R
2008/0155790 A1 7/2008 Hsu
2012/0023709 A1 2/2012 Hsu

OTHER PUBLICATIONS

U.S. Pat. No. 863,993, issued Aug. 8, 1907 to Hunter.
U.S. Pat. No. 899,612, issued Sep. 29, 1908 to Phillips.

* cited by examiner

*Primary Examiner* — Robert Sandy
(74) *Attorney, Agent, or Firm* — Grady K. Bergen; Griggs Bergen LLP

(57) ABSTRACT

A closure device for a flexible bag includes an elongated first clamp member having a channel and an elongated second clamp member that is configured as a blade that is receivable within the channel. The clamp members are pivotally coupled at a proximal end the clamp members to be pivoted between open and closed positions in a scissor-like fashion. The lower end of the second clamp projects a distance from the opening of the channel when the second clamp member is fully received within the channel when the closure device is in the closed position. The closure device facilitates closing the opening of the flexible bag by folding the open end of the flexible bag around at least the upper end of the second clamp member when the closure device is in the open position. The closure device is moved to the closed position so that the open end of the flexible bag is retained in the folded position when the closure device is in the closed position to effectively close off the opening of the flexible bag.

20 Claims, 5 Drawing Sheets

CLOSURE DEVICE FOR FLEXIBLE BAG

FIELD OF THE INVENTION

The present invention is in the field of closures for flexible bags. More specifically, the present invention relates to a closure device having elongated clamping members for closing an open end of a flexible bag.

BACKGROUND

Various methods and apparatus have been developed through the years for the cultivation of microbes, fungi (e.g., mushrooms), and other organisms for commercial purposes. Most commonly, bottles and bags are used for cultivating such organisms. Bag cultivation, however, has several advantages over bottle cultivation. It is an economic means of production, as well as a means for producing practically any variety of organism. Bag cultivation also allows for flexibility in crop production. Examples of such bags useful for the cultivation and/or incubation of microbes, fungi and the like are those described in U.S. Pat. Nos. 10,377,982 and 11,066,632.

In many instances, the flexible bags used for cultivation purposes are made from flexible thermoplastic sheet materials. These materials are formed into bags and filled with a substrate that serves as a nutrient food source for the organisms being grown. The flexible bags and the substrate must be sterilized prior to introducing the microbe, fungi, or other organism to be cultivated or incubated. Such sterilization may be through heat, radiation or chemical sterilization. Once sterilized, the organism to be grown is introduced into the open end of the bag containing the sterilized substrate. The open end of the bag is then closed. The openings of such flexible bags are often closed or sealed with a sealing machine that utilizes heat or ultrasonic welding to form a seal or seam from the material of the bag itself to close off the openings of the bag. While such seals may be effective, in many cases, the bags may be located remote from such sealing machines. Additionally, such seals cannot be reclosed if it is necessary to access the interior of the sealed bag and then reclose it.

Separate bag closure devices have been developed that can seal the openings of flexible bags and eliminate the need for a flexible bag sealing machine. Such devices typically involve a cylindrical rod or length of tubing about which the end of the bag is wrapped and inserted into an elongated C-shaped clamp member. Examples of these types of clamps are described in U.S. Pat. App. Pub. Nos. 2008/0155790A1 and 2012/0023709A1. While these clamps are effective, it is often difficult to insert and remove the rod or length of tubing from the clamp member. Moreover, such clamps are often formed as two separate pieces, which increases the likelihood that one piece may become lost or separated from the other.

The present invention overcomes these shortcomings. The closure device disclosed herein is simple in design, reusable, and can be sterilized or autoclaved for use with cultivation or incubation bags.

BRIEF DESCRIPTION OF THE DRAWINGS

For a more complete understanding of the disclosure, reference is now made to the following descriptions taken in conjunction with the accompanying figures, in which.

DETAILED DESCRIPTION

Figure 1:
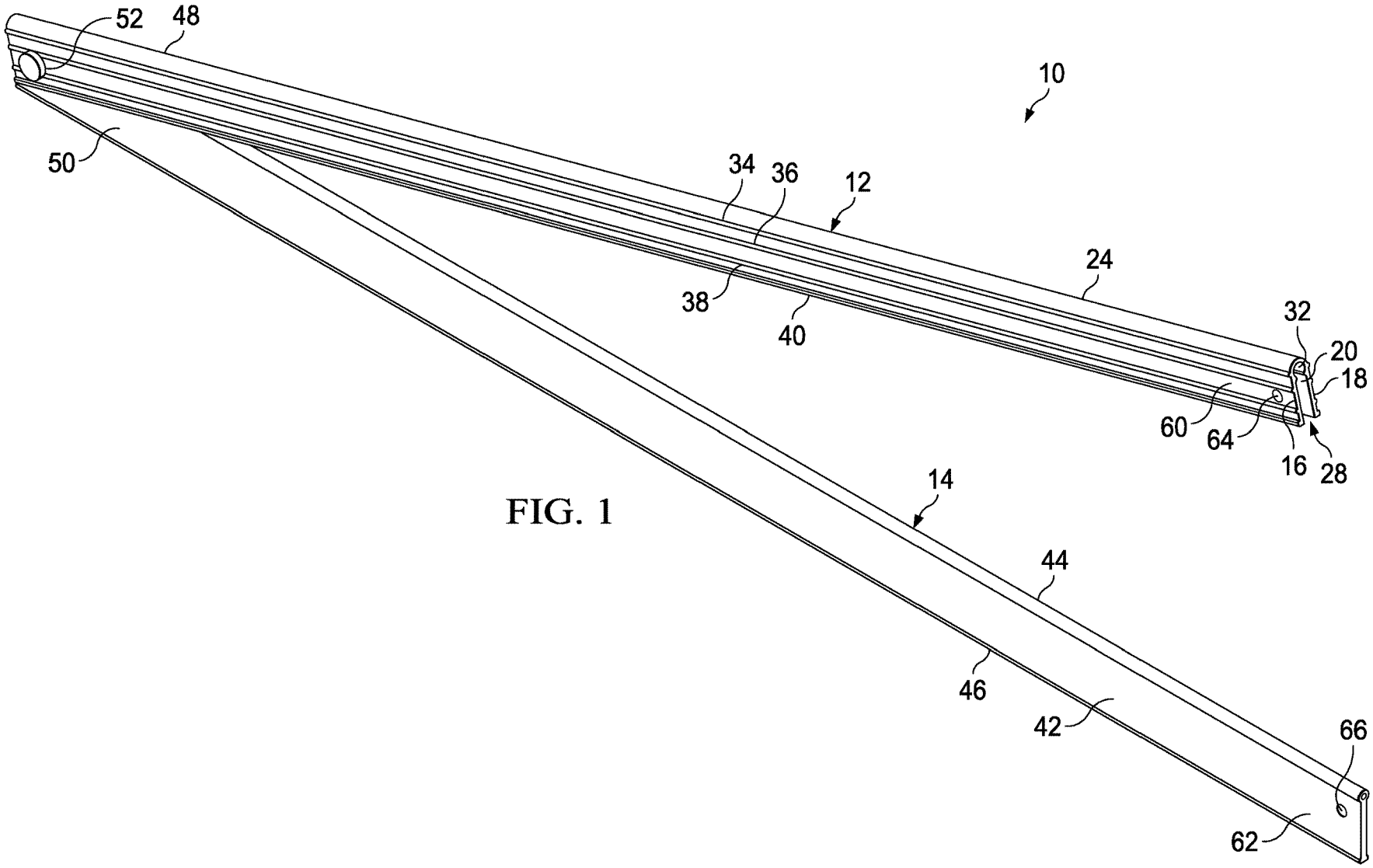
FIG. 1 is a perspective view of a closure device in an open position for closing an open end of a flexible bag and constructed in accordance with certain embodiments of the invention.
Figure 2:
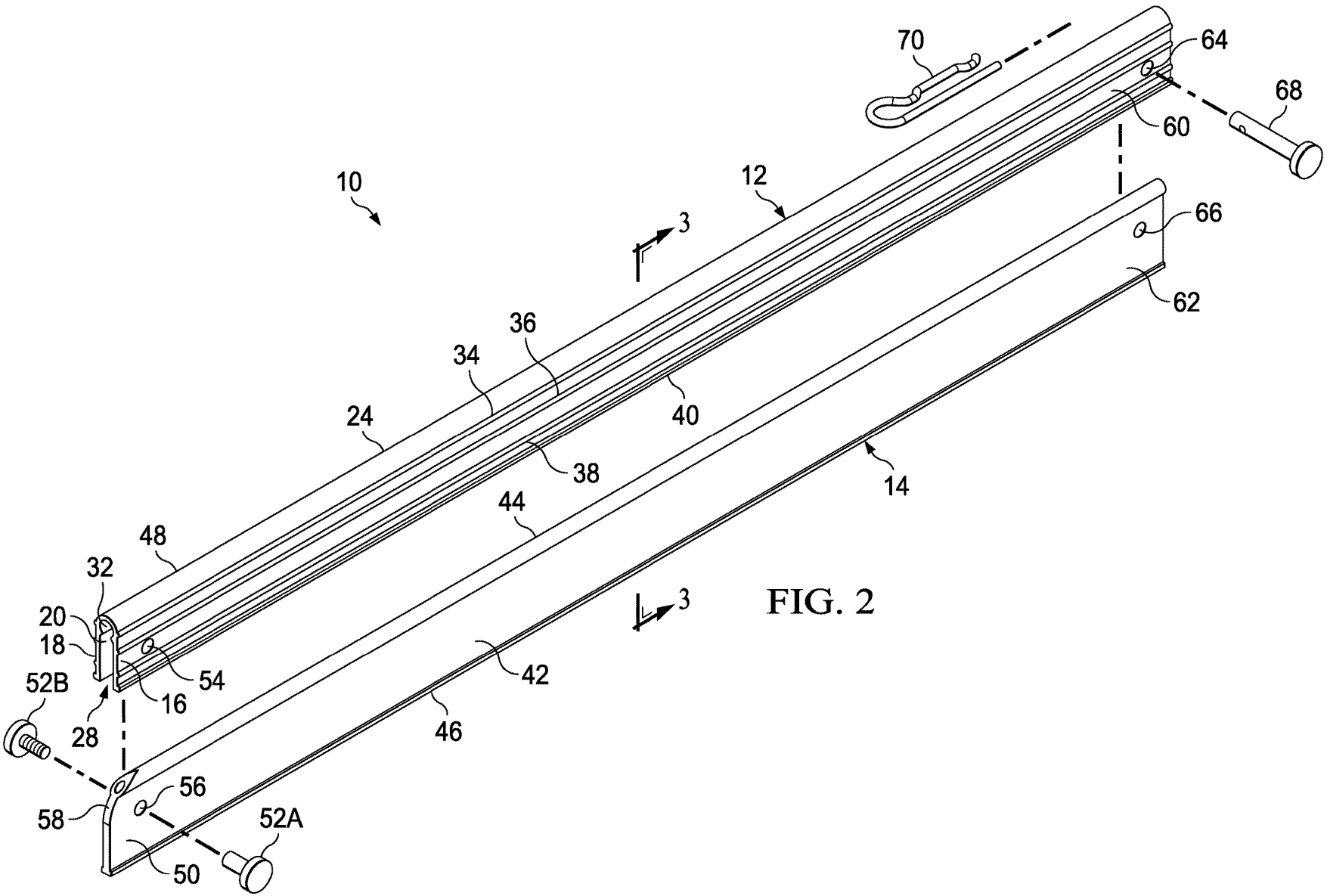
FIG. 2 is an exploded perspective view of the closure device of FIG. 1.

Referring to FIGS. 1 and 2, a closure device 10 for closing an opening of a flexible bag is shown. The closure device 10 includes cooperating upper and lower clamp members 12, 14, respectively. The terms "upper" and "lower" and other similar terms of orientation with respect to the closure device 10 are merely used for ease of reference and refer to their relative position as shown in the figures.

Each of the clamp members 12, 14 of the closure device 10 are elongated members. The lengths of each of the upper and lower clamp members 12, 14 are generally the same, although they may be of slightly different lengths and still perform the same function. The length of the closure member 10 and clamp members 12, 14 may vary and depend upon the type of bag and dimensions of the flexible bag with which it is intended to be used. Thus, the closure device 10 and its clamp members 12, 14 may be provided in different lengths for use with different size bags. This may from a few inches to several feet in length. The closure device 10 and clamp members 12, 14 may be of a length that facilitates extending along all or major portion of the width of the open end of the flexible bag with which it is to be used. In many cases, the length of the closure device 10 and members 12, 14 will exceed, at least slightly, the width of the open end of the flexible bag with which it is used to ensure that the entire opening of the bag is closed.

The clamp members 12, 14 and other components of the closure device 10 may be formed of materials that are sterilizable. This includes materials that can withstand heat, such as an autoclave, chemical or radiation sterilization techniques. In some embodiments, the clamp members 12, 14 and other components of the device 10 are formed from a plastic or polymeric material, which may be extruded, or metal materials. In non-limiting examples, the closure device 10 and/or clamp members 12, 14 are formed from polycarbonate or metal materials, which are autoclavable.

Figure 3:
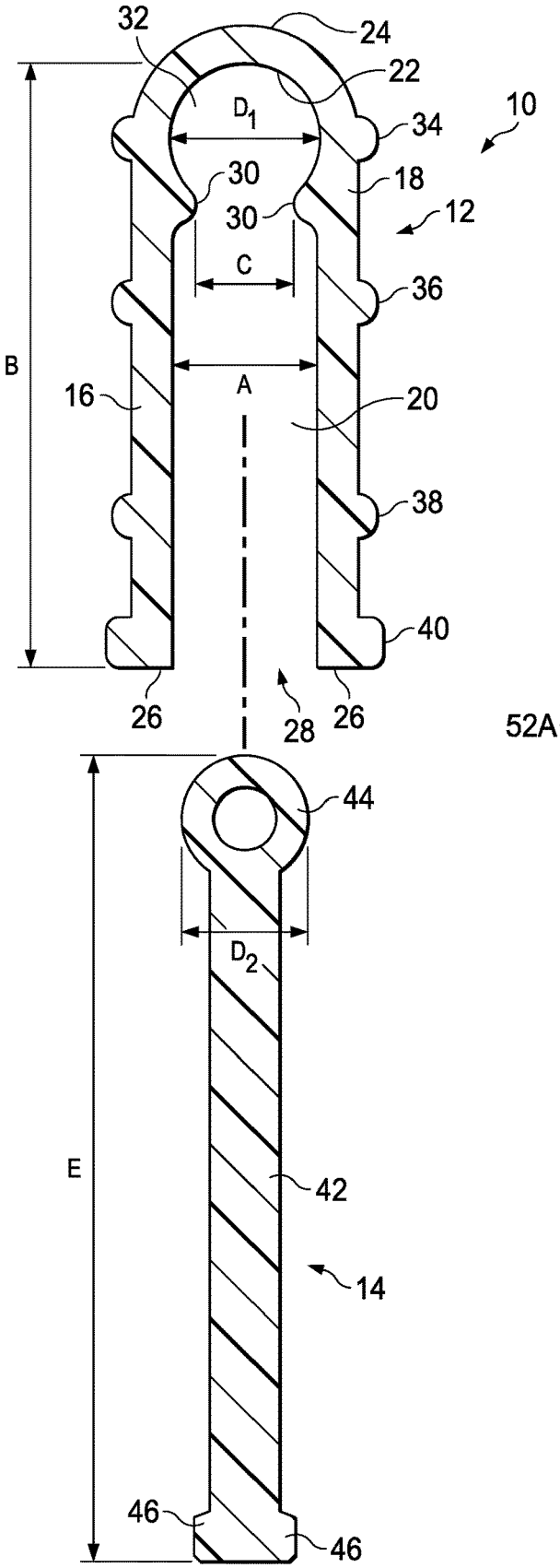
FIG. 3 is a transverse cross-sectional view of cooperating clamp members of the closure device of FIG. 1 taken along the lines 3-3, shown with the clamp members separated from one another, such as when the closure device is in an open position.

Referring to FIG. 3, a transverse cross section of each of the upper and lower clamp members 12, 14 is shown. As can be seen, the upper clamp member 12 has a generally inverted U-shaped transverse cross section. The U-shaped upper clamp member 12 has opposite legs 16, 18 that are spaced apart a distance or width A to define a channel 20 that extends along the entire length or substantially the entire length of the clamp member 12. As shown in FIG. 2, the legs 16, 18 may be generally flat or planar members that have a substantially uniform thickness along their lengths and heights. The legs 16, 18 extend along the length of the clamp member 12 and are parallel or substantially parallel (i.e., angled from 10° or less from one another) to one another along the length of the clamp member 12. In cases where the legs 16, 18 are substantially parallel (i.e., angled from 10° or less from one another) the distance or width A may be considered the greatest distance or width measured between the legs 16, 18 along their heights. In other embodiments the legs 16, 18 may have generally uniform thickness along their lengths and heights but be non-flat or non-planar, such has having a slightly curved configuration along the length of the upper clamp member 12, such that the clamp member 12 has a slight arc or curved configuration. In other embodiments, the legs 16, 18 may have a substantially uniform thickness but may have a curved or arcuate configuration along their heights. In many instances, the legs 16, 18 will have equal heights. In other cases, however, the legs 16, 18 may have different heights while still preforming the same function.

The legs 16, 18 are joined together at or near the bottom or closed end 22 of the channel 20 at a bend or curved portion 24 (FIG. 3) at the upper end of the clamp member 12, which closes off the bottom of the channel 20. The free ends 26 of the legs 16, 18 opposite the bend 24 terminate to form an opening or open end 28 of the channel 20.

The overall depth B of the channel 20 is measured from the bottom 22 of the channel 20 to the ends 26 of the legs 16, 18 or the end 26 of the shortest leg 16, 18, if the legs 16, 18 are of non-equal heights. In certain embodiments, the channel has an overall depth B that is at least one and a half times the width A of the channel 20 along the length of the clamp member 12. In certain embodiments, the overall depth B of the channel 20 is at of at least, equal to, and/or between any two of 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, and 6.0 times the width A of the channel 20.

The legs 16, 18 of the upper clamp member 12 have opposite inward facing projections or ridges 30 that face one another within the channel 20. The projections or ridges 30 extend along all or a portion of the length of the upper clamp member 12 on each leg 16, 18 and are parallel to one another to form a constriction have a width C within the channel 20. The projections or ridges 30 may be formed by an increased area of thickness of the legs 16, 18. Alternatively, the projections or ridges 30 may be formed by a small inwardly projecting bend or undulation of each the legs 16, 18, such as a pinched together portion of the legs 16, 18, with the legs 16, 18 having a uniform thickness or substantially uniform thickness throughout its height. The width C is less than the width A of the channel 20. The projections or ridges 30 are spaced from the bottom 22 of the channel 20 and define a recessed area 32 that is at or near the bottom 22 of the channel 20. The recessed area 32 may have a circular or oval transverse shape or configuration or at least some transverse portions of the recessed area 32 may be arcuate or curvilinear concave in shape or configuration. Such arcuate or curvilinear portions may be around, at or near the projections 30, with the remaining transverse portions of the recessed area 32 being non-arcuate or curvilinear. The recessed area 32 has a width or diameter $D_1$ that is greater than the width C of the constriction formed by the projections 30.

The exterior of the upper clamp member 12 may have one or more outward facing projections or ridges 34, 36, 38, 40 on each leg 16, 18. The projections 40 are formed on the free ends 26 of the legs 16, 18. The projections or ridges 34, 36, 38, 40 are spaced apart along the height of each leg 16, 18 and form parallel or substantially parallel ridges that extend along all or a portion of the length of the clamp member 12 on each leg 16, 18. The projections or ridges 34, 36, 38, 40 may serve to strengthen and reinforce the legs 16, 18 of the clamp member 12 and also facilitate grasping and holding the upper clamp member 12 during use. In certain embodiments, the projections or ridges 34, 36, 38, 40 may be formed by an increased area of thickness of the legs 16, 18. Alternatively, the projections or ridges 34, 36, 38, 40 may be formed by a small outwardly projecting bends or undulations of each the legs 16, 18, with the legs 16, 18 having a uniform thickness or substantially uniform thickness throughout its height, with the legs still retaining an overall generally flat or planar configuration.

The lower clamp member 14 of the closure device 10 is configured to be received within the channel 20 of the upper clamp member 12. The lower clamp member 14 includes a main body 42 that is configured as a generally flat or planar body or bar that may be of generally uniform thickness along its length and height. In other embodiments, there may be variations in its thickness but with an overall flat or planar configuration. In other embodiments the main body 42 may have generally uniform thickness along its length and height but be non-flat or non-planar, such that the clamp member 14 has a slight arc or curved configuration, which may correspond to an arc or curved configuration of the upper clamp member 12.

Figure 5:
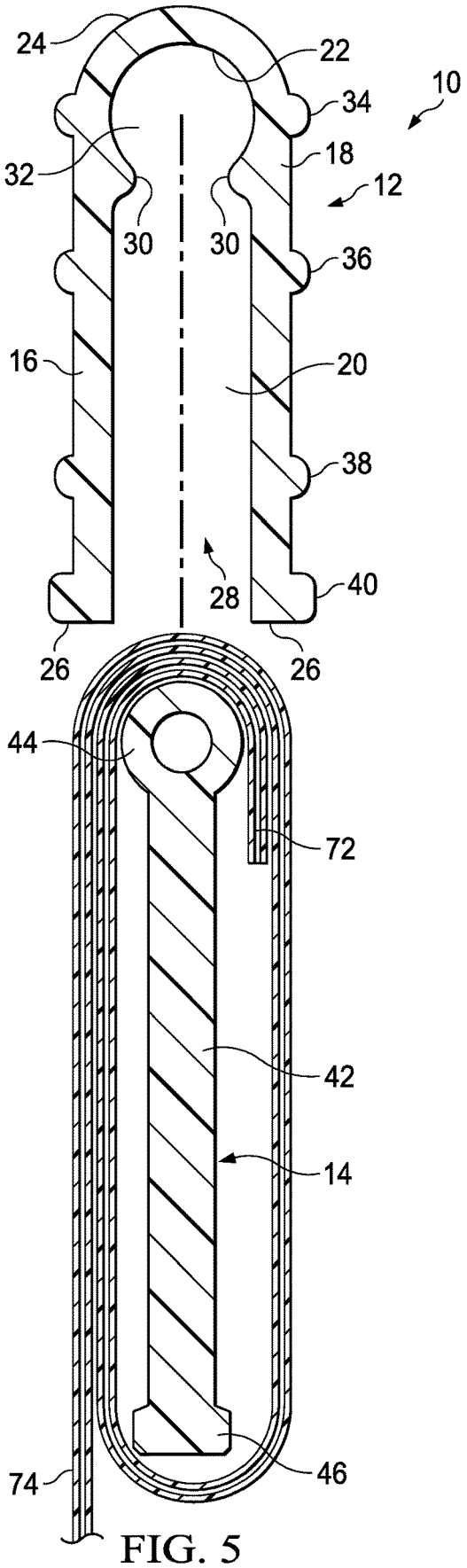
FIG. 5 is a transverse cross-sectional view of the cooperating clamp members of the closure device of FIG. 1, shown with an open end of a flexible bag wrapped around a lower clamp member while the closure device is in an open position.

A head 44 is joined to the upper end of the main body 42. The head 44 constitutes a widened portion of the clamp member 14 that has greater width than that of the thickness of the main body 42. The head 44 is configured to be received within the recessed area 32 of the upper clamp member 12. In particular embodiments, the head 44 may have a circular or oval transverse cross section, which may correspond to the shape of the recessed area 32 of the clamp member 12. The head 44 should have a width or diameter $D_2$ that is less than $D_1$ of the recessed area 32 and be sized and configured to provide a gap or free space or room to accommodate layers of the flexible bag with which it is used between the gaps or spaces between the recessed area 32 and the head 44, as described later. Additionally, the head 44 has a width or diameter $D_2$ that is greater than the width C of the constriction formed by the projections 30 of the upper clamp member 12. The head 44 may extend along all or a portion of the length of the lower clamp member 14 or body 42 and correspond in length to the length of the recessed portion 32 formed on the upper clamp member 12. The head 44 may be solid or hollow, having a central passage or bore, as shown in FIG. 5, that extends along all or a portion of the clamp member 14.

The thickness of the main body 42 is less than the width A of the channel 20 or those portions of the main body 42 that are received within the channel 20, as described later on, having a thickness that is less than the width A of the channel 20. The lower end of the clamp member 14 or main body 42 is provided with one or more outward extending projections or ridges 46, which may be formed by an increased thickness of the body 42. As shown in FIG. 3, there are two opposite facing projections 46 on the lower end of the clamp member 14. The projections or ridges 46 extend along all or a portion of the length of the lower clamp member 14. The projections or ridges 46 may serve to strengthen and reinforce the main body 42 of the clamp member 14 and facilitate grasping and holding the lower clamp member 14 during use. In certain embodiments, other outward projections or ridges (not shown) may be spaced apart along the height of the main body 42 and/or the projections or ridges 46 may be spaced above the lower end of the main body 42. Such outward projections or ridges may be formed from small areas of increased thickness of the main body 42 or by small bends or undulations formed in the body 42.

Figure 4:
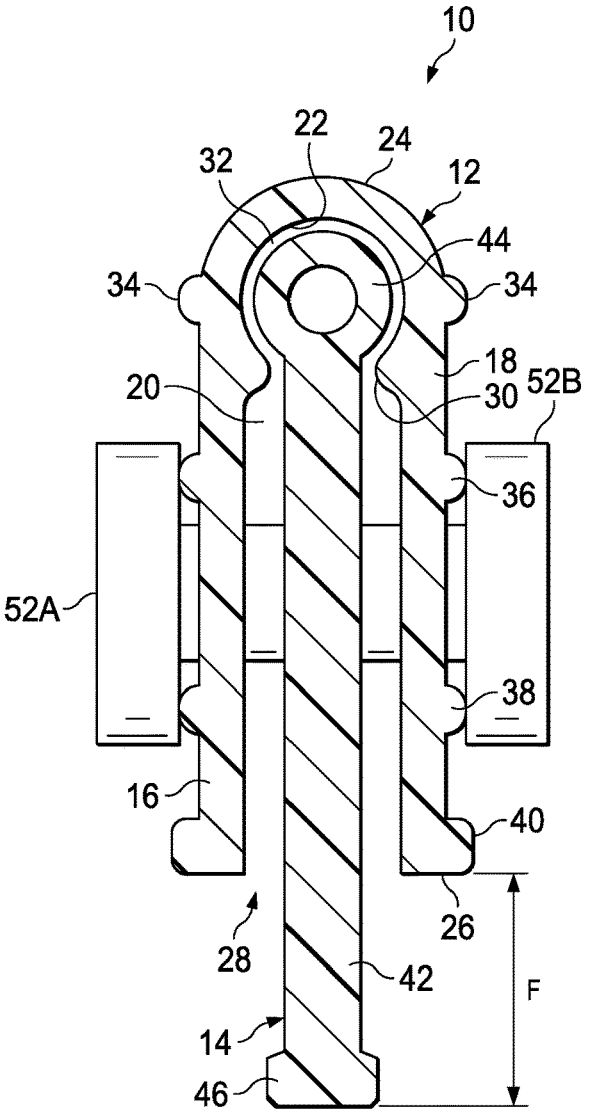
FIG. 4 is a transverse cross-sectional view of the cooperating clamp members of the closure device of FIG. 1, shown with the clamp members closed position.

The upper and lower clamp members 12, 14 of the closure device 10 are configured to cooperate with one another. The lower clamp member 14 has a height E between the upper and lower ends of the lower clamp member 14 that is greater than the depth B of the channel 20. FIG. 4 shows the closure device 10 in a closed position wherein the lower clamp member 14 is fully received within the channel 20 of the upper clamp member 12. When the closure device 10 is in a fully closed position, the head 44 of the lower clamp member 14 is received within the recessed area 32 of the upper clamp member 12 above the projections 30. When in this fully closed position, the lower end of the lower clamp projects a distance F from the opening 28 of the channel 20. When the head 44 rests directly against the bottom of the channel 20, the distance F may be defined as the height E of the lower clamp member 14 minus the overall depth B of the channel 20 (i.e., F=E−B). The distance of projection F may be from ¼ inch to 2 inches or more when the closure device 10 is in the fully closed position. In particular embodiments, this projection distance F may be at least, equal to, and/or between any two of ¼ inch, ⅜ inch, ½ inch, ⅝ inch, ¾ inch, ⅞ inch, 1 inch, 1⅛ inch, 1¼ inch, 1⅜ inch, 1½ inch, 1⅝ inch, 1¾ inch, 1⅞ inch, 2 inches, 2⅛ inch, 2¼ inches, 2⅜ inches, 2½ inches, 2⅝ inches, 2¾ inches, 2⅞ inches, and 3 inches. Such projection F allows for ease of grasping of the lower clamp member 14 during opening and closing of the closure device 10.

Referring to FIG. 1, the clamp members 12, 14 of the closure device 10 are pivotally coupled at one end of the closure device 10. As shown, a proximal end 48 of the upper clamp member 12 is pivotally coupled to a proximal end 50 of the lower clamp member 12 by a hinge or fastener 52 to allow the first and second clamp members 12, 14 to be pivoted between open and closed positions of the closure devise 10 in a scissor-like fashion. In the embodiment shown, the fastener 52 is a barrel nut or Chicago screw having an internally threaded nut portion 52A with a post having smooth cylindrical exterior surface that is passed and extends through concentric apertures 54, 56 formed through the thickness of the proximal ends 48, 50 of the upper and lower members 12, 14, respectively. The nut portion 52A is sized and configured to form a hinge or axle about which the upper and lower members 12, 14 can pivot. A corresponding screw 52 B is used to secure the nut 52A within the apertures 54, 56 and couple the members 12, 14 together. Other hinges, pivotal fasteners or pivotal coupling means may be used for pivotally joining the ends of the members 12, 14 together, however.

As shown in FIG. 1, when coupled together, the upper portion of the proximal end 50 of the lower clamp member 14 is received within the channel 20. As shown in FIG. 2, a corner of the upper portion of the proximal end 50, including a portion of the head 44, of the lower clamp member 14 is cut out or shaped, such as at the curved portion 58, to provide a clearance to allow or accommodate relative pivotal movement of the upper and lower members 12, 14, while the proximal end 50 of lower clamp is retained within the channel 20 as the clamp members 12, 14 are moved to an open position. In lieu of the curved portion 58, an upper portion of the bottom of the channel 22 at the proximal end 48 of the upper clamp member can be cut out, shaped, or removed (not shown) to provide a clearance and accommodate the corner of the upper portion of the proximal end 50 of the lower clamp member as the members 12, 14 are moved to an open position. Other configurations can also be employed to allow pivotal coupling of the upper and lower clamp members 12, 14 at their proximal ends that allow relative pivotal movement to achieve the same function and purpose as described herein.

The opposite distal ends 60, 62 of the upper and lower clamp members 12, 14 are configured to be releasably coupled together when the closure device 10 is in the closed position. In the embodiment shown, this may be achieved by providing the distal ends 60, of the clamp members 12, 14 with apertures 64, 66, respectively, formed through their thicknesses. In the embodiment shown, the apertures 64, 66 are concentrically aligned when the closure device 10 is in the closed position, with the lower member 14 being fully received within the channel 20 of the upper clamp member 12. A removable fastener may be used to engage the concentric apertures 64, 66, such as clevis pin 68, passed through the apertures 64, 66, which may be secured in place with a removable hairpin cotter or R-clip 70. Other fasteners may be used for releasably coupling the distal ends 60, 62 of the upper and lower clamp members 12, 14 when they are in the closed position, as well. Alternatively, the clamp members 12, 14 themselves may be provided with releasable interlocking mechanisms, such as a snap-fit mechanism, which releasably couple the clamp members 12, 14 of the closure device 10 together when in the closed position without the use of separate fasteners. Such a snap-fit may be provided, for instance, by the projections or ridges 30 of the upper clamp member 12 engaging the head 44 of the lower clamp member 14, with the resiliency of the legs 16, 18 providing a biasing force to releasably retain the head 44 and lower clamp member 14 in place when the closure device 10 is in the closed position.

In use, with the closure device 10 initially in an open position, as shown in FIG. 1, an open end 72 of a flexible bag 74 is folded or wrapped along its width around the lower clamp member 14, as shown in FIG. 5. This may be merely folding the open end 72 over the head 44 of the lower clamp member or wrapping the open end 72 one or more times around the lower clamp member 14, such as illustrated in FIG. 5.

Figure 6:
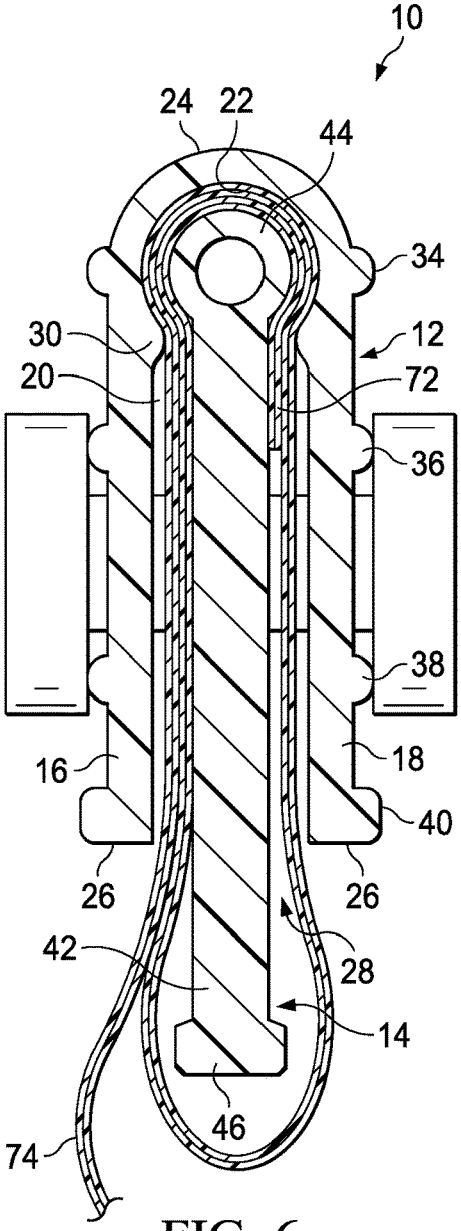
FIG. 6 is a transverse cross-sectional view of the cooperating clamp members of the closure device of FIG. 5, shown with the open end of the flexible bag wrapped around the lower clamp member with the closure device in a closed position to close the open end of the bag.

The closure device 10 is then moved to the closed position, with the head 44 passing between the constriction formed by the projections 30 so that it is received within the recessed area 32. This is shown in FIG. 6. If used, the clevis pin 68 may be inserted through the apertures 62, 64 and the clip 70 secured to ensure the closure device 10 remains in the closed position. As discussed previously, the recessed area 32 of the upper clamp member 12 and the head 44 of the lower closure member 14 may be sized and configured to provide a gap or spacing to accommodate the thicknesses of the layers of the flexible bag 74 folded around the head 44 of the lower clamp member 14. In many instances, the spacing or gap should be that which provides a relatively tight fit so that it forms an air-tight or gas-tight seal and not be so great or loose that gases can escape or pass through the open end 72 of the flexible bag when it is held by the closure device 10 when it is in the closed position. Wrapping several layers of the flexible bag 74 around the closure member 14 may be used to increase the thickness of the layers to achieve such a tight fit. If multiple wraps are needed and there is insufficient length of the flexible bag 74 to achieve multiple wraps, an additional layer or layers of additional flexible material may be folded over the head 44 to provide a tighter fit.

Figure 7:
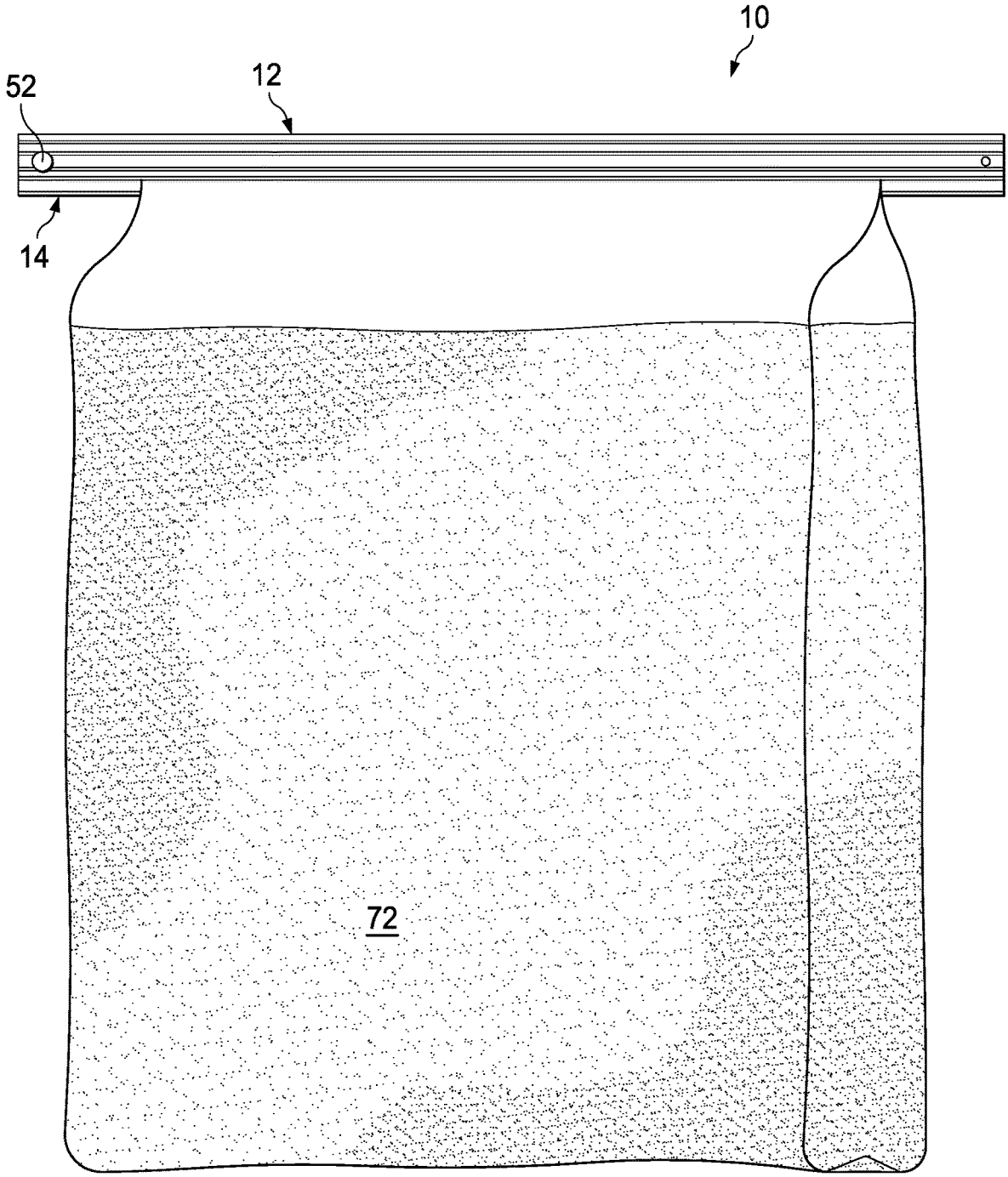
FIG. 7 is an elevational view of the closure device of FIG. 1 with the open end of a flexible bag being held securely and closed by the closure device.

FIG. 7 shows the closure device 10 coupled to an open end of a flexible bag 74 in the manner described to close the open end of the flexible bag 74. As can be seen, the bag 74 may be filled with a material, such as a sterilized substrate and an organism to be cultivated or incubated.

When it is desired to open the bag 74, the clevis pin 68 is removed and the clamp members 12, 14 are moved to an open position, such as shown in FIGS. 1 and 5. The open end 72 of the bag is then unfolded or unwrapped from the lower closure member 14 so that the open end 72 is accessible and the contents within the interior of the bag 74 can be accessed through the open end 72.

With the closure device 10 removed from the bag, the clamp members 12, 14 can be moved to the closed position and the clevis pin 68 may be inserted through the apertures 62, 64 and the clip 70 so that the closure device 10 remains in the closed position during storage.

While the invention has been shown in only some of its forms, it should be apparent to those skilled in the art that it is not so limited but is susceptible to various changes and modifications without departing from the scope of the invention. Accordingly, it is appropriate that the appended claims be construed broadly and in a manner consistent with the scope of the invention.

I claim:

1. A closure device for a flexible bag to facilitate closing an opening of the flexible bag, the closure device comprising:

an elongated first clamp member having a generally U-shaped transverse cross section with opposite legs that define a channel that extends along the length of the first clamp member, the legs of the first clamp member being joined at or near the bottom of the channel and the ends of the legs defining an opening of the channel; and an elongated second clamp member that is configured as a blade that is receivable within the channel of the first clamp member, the second clamp member being pivotally coupled at a proximal end to a proximal end of the first clamp member to allow the first and second clamp members to be pivoted between open and closed positions of the closure devise in a scissor-like fashion, the second clamp member having an upper end and a lower end with the height between the upper and lower ends of the second clamp member being greater than the depth of the channel so that the lower end of the second clamp projects a distance from the opening of the channel when the second clamp member is fully received within the channel of the first clamp member when the closure device is in the closed position; and wherein the closure device facilitates closing the opening of the flexible bag by folding the open end of the flexible bag around at least the upper end of the second clamp member when the closure device is in the open position, the closure device being moved to the closed position so that the open end of the flexible bag is retained in the folded position when the closure device is in the closed position to effectively close off the opening of the flexible bag; and wherein the second clamp member has a widened head at the upper end of the second clamp member that extends along at least a portion of the length of the second claim member; and wherein the first clamp member has a recess between the legs at or near the bottom of the channel configured to receive the head of the second clamp member and any portions of the flexible bag folded around the widened head when the closure device is in the closed position, the legs of the first clamp member having opposite inward facing projections that face one another within the channel, the projections being spaced apart a distance that is less than the width of the head of the second clamp member, the legs of the first clamp member having a sufficient degree of resilience so that the legs resiliently expand to allow the head of the second clamp member and any portions of the flexible bag folded around the widened head to pass between the inward facing projections when the closure device is moved to the closed position, the legs resiliently contracting after the head of the second clamp member is received with the recess of the first clamp member to facilitate retaining the head of the second clamp member within the recess.

2. The closure device of claim 1, wherein:

at least a portion of the proximal end of the second clamp member remains within the channel of the first clamp member when the closure device is in the open position.

3. The closure device of claim 1, wherein:

the lower end of the second clamp projects a distance of from ¼ inch to 2 inches from the opening of the channel when the second clamp member is fully received within the channel of the first clamp member.

4. The closure device of claim 1, wherein:

the head of the second clamp member has a generally circular transverse cross section.

5. The closure device of claim 1, wherein:

the channel has an overall depth that is at least two times the width of the channel along the length of the channel.

6. The closure device of claim 1, wherein:

the lower end of the second clamp member has an outwardly projecting ridge along at least a portion of the length of the second clamp member to facilitate grasping of the second clamp member.

7. The closure device of claim 1, wherein:

the legs of the first clamp member have outwardly projecting ridges that extend along at least a portion of the length of the first clamp member to facilitate grasping of the first clamp member.

8. The closure device of claim 1, wherein:

the closure device is formed from a sterilizable material.

9. The closure device of claim 1, wherein:

the closure device is formed from at least one of polycarbonate and metal.

10. The closure device of claim 1, wherein:

the distal ends of the first and second clamp members are configured to be releasably locked together when the closure device is in the closed position.

11. A method of closing an opening of a flexible bag, the method comprising:

providing a closure device comprising:

an elongated first clamp member having a generally U-shaped transverse cross section with opposite legs that define a channel that extends along the length of the first clamp member, the legs of the first clamp member being joined at or near the bottom of the channel and the ends of the legs defining an opening of the channel; and an elongated second clamp member that is configured as a blade that is receivable within the channel of the first clamp member, the second clamp member being pivotally coupled at a proximal end to a proximal end of the first clamp member to allow the first and second clamp members to be pivoted between open and closed positions of the closure devise in a scissor-like fashion, the second clamp member having an upper end and a lower end with the height between the upper and lower ends of the second clamp member being greater than the depth of the channel so that the lower end of the second clamp projects a distance from the opening of the channel when the second clamp member is fully received within the channel of the first clamp member when the closure device is in the closed position; wherein the second clamp member has a widened head at the upper end of the second clamp member that extends along at least a portion of the length of the second claim member; and wherein the first clamp member has a recess between the legs at or near the bottom of the channel configured to receive the head of the second clamp member and any portions of the flexible bag folded around the widened head when the closure device is in the closed position, the legs of the first clamp member having opposite inward facing projections that face one another within the channel, the projections being spaced apart a distance that is less than the width of the head of the second clamp member, the legs of the first clamp member having a sufficient degree of resilience so that the legs resiliently expand to allow the head of the second clamp member and any portions of the flexible bag folded around the widened head to pass between the inward facing projections when the closure device is moved to the closed position, the legs resiliently contracting after the head of the second clamp member is received with the recess of the first clamp member to facilitate retaining the head of the second clamp member within the recess;

folding the open end of the flexible bag around at least the upper end of the second clamp member when the closure device is in the open position; and moving the closure device to the closed position so that the open end of the flexible bag is retained in the folded position when the closure device is in the closed position to effectively close off the opening of the flexible bag.

12. The method of claim 11, wherein:

at least a portion of the proximal end of the second clamp member remains within the channel of the first clamp member when the closure device is in the open position.

13. The method of claim 11, wherein:

the lower end of the second clamp projects a distance of from ¼ inch to 2 inches from the opening of the channel when the second clamp member is fully received within the channel of the first clamp member.

14. The method of claim 11, wherein:

the head of the second clamp member has a generally circular transverse cross section.

15. The method of claim 11, wherein:

the channel has an overall depth that is at least two times the width of the channel along the length of the channel.

16. The method of claim 11, wherein:

the lower end of the second clamp member has an outwardly projecting ridge along at least a portion of the length of the second clamp member to facilitate grasping of the second clamp member.

17. The method of claim 11, wherein:

the legs of the first clamp member have outwardly projecting ridges that extend along at least a portion of the length of the first clamp member to facilitate grasping of the first clamp member.

18. The method of claim 11, wherein:

the closure device is formed from a sterilizable material.

19. The method of claim 11, wherein:

the closure device is formed from at least one of polycarbonate and metal.

20. The method of claim 11, wherein:

the distal ends of the first and second clamp members are configured to be releasably locked together when the closure device is in the closed position.

* * * * *